United States Patent [19]

Bonneville et al.

[11] Patent Number: 5,070,577

[45] Date of Patent: Dec. 10, 1991

[54] SEPERABLE HINGE

[75] Inventors: Gary R. P. Bonneville, Eagan, Minn.; David G. Corry, Houston, Tex.

[73] Assignee: World Container Corporation, Burnsville, Minn.

[21] Appl. No.: 478,089

[22] Filed: Feb. 9, 1990

[51] Int. Cl.[5] ..... F05D 7/10

[52] U.S. Cl. ..... 16/260; 16/267; 16/268; 16/386; 16/DIG. 13

[58] Field of Search ..... 220/262, 263; 248/97, 248/99; 16/265-267, 260, 356, 385, 386, DIG. 13

[56] References Cited

U.S. PATENT DOCUMENTS

| | | | |
|---|---|---|---|
| 770,595 | 9/1904 | Lovette | 16/260 |
| 782,428 | 2/1905 | Struble et al. | 16/267 |
| 1,632,116 | 6/1927 | Buss | 16/267 |
| 3,628,683 | 12/1971 | Friedrich . | |
| 3,870,185 | 3/1975 | Sanders . | |
| 3,874,546 | 4/1975 | Sanders . | |
| 3,999,676 | 12/1976 | Trebilcock . | |
| 4,000,827 | 1/1977 | Emery . | |
| 4,005,795 | 2/1977 | Mikkelsen . | |
| 4,020,967 | 5/1977 | Hammond . | |
| 4,081,099 | 3/1978 | Shead . | |
| 4,099,640 | 7/1978 | Nessfield . | |
| 4,162,737 | 7/1979 | Clive-Smith . | |
| 4,320,845 | 3/1982 | Waller . | |
| 4,506,798 | 3/1985 | Goutille . | |
| 4,515,424 | 5/1985 | Sakurai | 16/266 |
| 4,598,889 | 7/1986 | Remington | 16/260 |
| 4,677,647 | 6/1987 | Gyenge . | |
| 4,809,851 | 3/1989 | Oestreich, Jr. . | |

FOREIGN PATENT DOCUMENTS

| | | | |
|---|---|---|---|
| 850703 | 9/1952 | Fed. Rep. of Germany | 16/386 |
| 2401867 | 7/1975 | Fed. Rep. of Germany | 16/266 |

*Primary Examiner*—Richard K. Seidel
*Assistant Examiner*—Edward A. Brown
*Attorney, Agent, or Firm*—Robert A. Elwell; Harold D. Jastram

[57] ABSTRACT

A collapsible container includes a base and walls. Each of the walls are connected to an edge of the base at a first edge of the wall. Each of the walls are also connected to adjacent walls and have a hinge, integrally formed in the wall to allow the wall to folded. The integral hinge allows the wall to be folded and to be separated into two pieces. The hinge includes at least a first hinge pin and at least a second hinge pin, each with a cylindrical surface portion and a flat surface portion. The hinge also includes arms adapted for rotating on the pins. The hinge members can be separated by moving the arms over the flat surfaces of the pins.

2 Claims, 4 Drawing Sheets

SEPERABLE HINGE

BACKGROUND OF THE INVENTION

The present invention relates to reusable containers, and in particular plastic reusable heavy duty containers which may be collapsed when empty to save space.

Modern mass production techniques frequently involve the production of materials, components, or parts at a site removed from an assembly plant. Containers for shipping the remotely produced materials or parts to the assembly plant may be either disposable or reusable Reusable containers which are not collapsible remain bulky when empty, increasing the expense of returning them to the remote site. It is previously been suggested to employ collapsible containers. Such containers require reduced space when empty and therefore reduced transportation cost during their return trip. Additionally, collapsible containers require less storage space when the waiting filling. Generally metal containers are heavy and expensive and require high maintenance. Corrugated containers, while less expensive, lack strength and durability. Plastic containers, however, are lighter, cheaper and chemically resistant. Recycling or alternatively disposal costs and energy requirement of plastic containers are lower than either corrugated or metal containers. There exists a need for efficient, relatively low cost, plastic, reusable and collapsible containers.

SUMMARY OF THE INVENTION

The present invention includes a collapsible container having a base and a plurality of walls connected to the base. Each of the walls is reversibly connected to the adjacent wall at edges adjoining the edge connected to the base. Each of the walls include an integral hinge means to allow folding the walls about a hinge axis parallel to the base. The hinge means can be separated into a first member and a second member, thereby allowing the large portion of one or more walls to be removed for loading or replacement of damaged walls The separable wall portion may be separated when the wall is rotated outward and away from the base. The contaner also includes a mechanism for holding a single upper wall portion perpendicular to the base and co-planar with the lower wall portion.

The invention also includes a separable hinge including a first and a second hinge member. The first hinge member includes a first hinge pin having a surface with a cylindrical portion and a flat surface connected to the cylindrical portion at two parallel lines. The first hinge member also includes a second hinge pin, spaced apart from the first hinge pin and having a surface with a cylindrical portion, on a common axis to the first pin, and a flat surface connected to the cylindrical portion at two parallel lines. The second hinge member includes a pair of arms for contacting the first and second pins respectfully. The hinge members can be separated by withdrawing or sliding the arms over the flats on the pins.

DETAILED DESCRIPTION OF THE PREFERRED EMBODIMENTS

Figure 1:
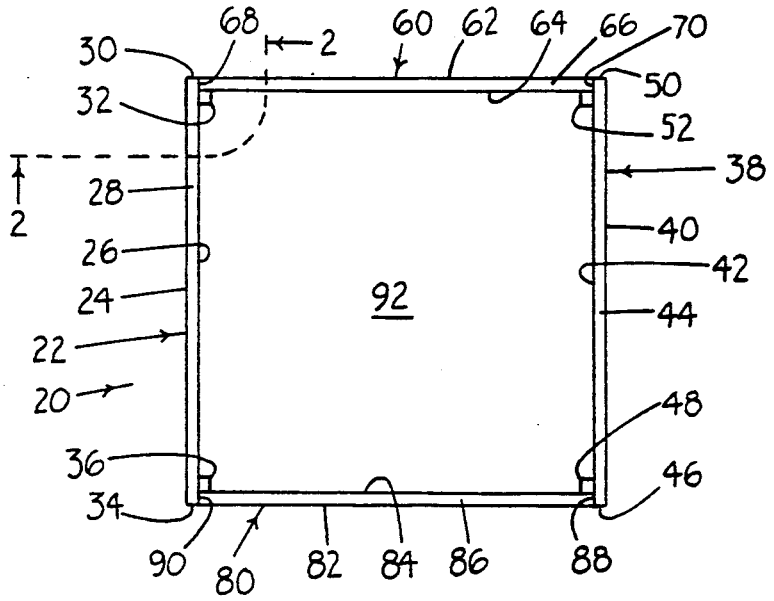
FIG. 1 is the top view of a preferred embodiment of the present invention.

In the first embodiment, the present invention is a container 20, as shown in FIG. 1. The container 20 includes a first wall 22 with an outside face 24, an inside face 26, a top edge 28, a first vertical edge or end 30 with vertical connecting lugs 32, and a second vertical edge or end 34 having vertical connecting lugs 36 associated therewith When viewed from the exterior, the first vertical end 30 would be on the left and second vertical end 34 would be on the right; when viewed from the inside of the container vertical lugs 32 associated with first vertical end 30 would be on the right side and second vertical lugs 34, associated with second vertical end 36 would be on the viewer's left side A second vertical wall 38 lies opposite in facing first vertical wall 22. Second vertical wall 38 also has an exterior face 40, an interior face 42, a top edge 44, a first vertical edge or end 46 with associated vertical connecting lugs 48, and a second vertical end 50 with associated second vertical connecting lugs 52 When viewed from the exterior, first vertical end 46 is on the left and second vertical end 50 is on the right; when viewed from the interior first vertical lugs 48 are on the right and second vertical lugs 52 are on the left.

Container 20 also includes a second pair of connecting walls 60 and 80. Wall 60 has an outside face 62, an inside face 64, a top edge 66, a first end 68 connected to wall 22 adjacent first end 30. A second end 70 connects to wall 38 adjacent end 50. Vertical lugs 32 and 52 serve to connect the ends 68 and 70 of wall 60 adjacent end 30 of wall 22 end 50 of wall 38 respectively.

A fourth wall 80 is analogous to wall 60 and includes an outside face 82, an inside face 84, a top edge 86, a vertical connecting end 88 connected to wall 38 adjacent end 46 with vertical lugs 48. A second vertical end 90 of wall 80 connects to wall 22 adjacent vertical end 34 by vertical lugs 36. Container 20 also includes a base 92.

Figure 2:
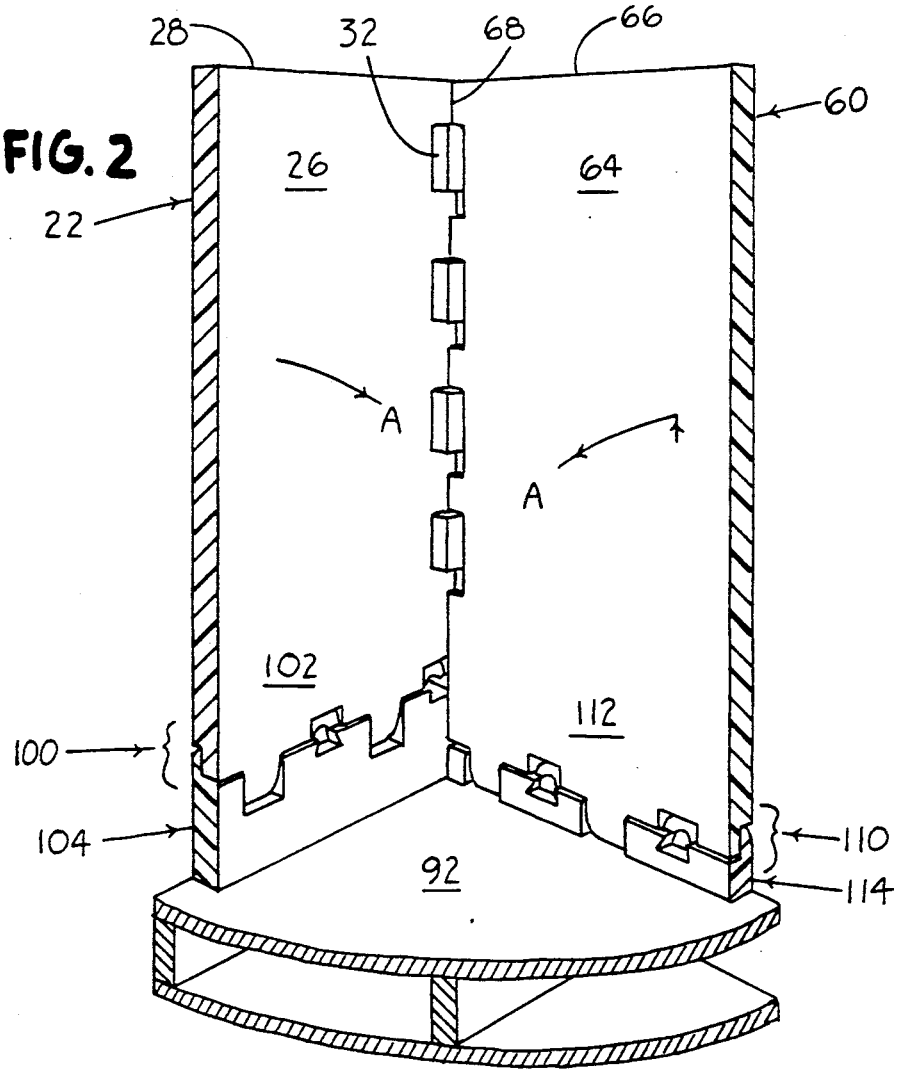
FIG. 2 is a prospective view of a portion of the embodiment shown in FIG. 1 at line 2—2.

Vertical wall 22 is connected to the base 92 by integral hinge 100 and lower wall 104, as shown in FIG. 2. Hinge 100 connects the bottom edge 102 of wall 22 to lower wall 104 which in turn is connected to and rises vertically from base 92. A preferable method of attaching lower wall 104 to base 92 is by mortise and tenon joining system as shown in U.S. Pat. No. 4,809,851. Alternative methods of attachment include screw fasteners or integral moldings. Similarly, the wall 60 is connected to the base 92 through an analogous hinge 110 near its bottom edge 112 connecting it to a lower wall 114 also connected to and rising from the base 92. Lower wall 114 supports the pivot axis of hinge 100 at approximately 80–110 millimeters above the base 92.

As previously mentioned, wall 60 is connected to wall 22 at vertical connecting lugs 32, adjacent the first end 30 of wall 22. Wall 60 may be disconnected from wall 22 by lifting wall 60 vertically, i.e., perpendicular to the plane of base 92 and parallel to the first vertical end 30 and the vertical end 68. Hinge 110, as will later be explained, is specially designed to allow wall 60 to move upward approximately 25 millimeters without fully releasing or disconnecting wall 60 from lower wall 114. Vertical travel of wall 60 disconnects vertical edge 68 from the connecting lugs 32 of wall 22, as will later be explained.

In a vertically raised status, wall 60 is free to rotate on the axis of hinge 110, such that face 64 approaches the base 92, hereinafter defined as rotating inward. The inward rotation is shown as "A" in FIG. 2. Alternatively wall 60 may be rotated about the axis of hinge 110 away from base 92, i.e., from its vertical lug 32 engaging position to a horizontal and outwardly facing orientation, i.e., such that inside face 64 is now exposed upwardly and outside face 62 is now downward.

Hinge 110 also has the unique property of allowing wall 60 to be separated from base wall 114 in the outward, horizontal orientation, by further moving wall 60 radially outward away from the pivot axis of hinge 110. (The details of this separable feature of hinge 110 will be further explained later in this description.) Hinge 100 also incorporates similar properties to hinge 110, such that when wall 22 is unconnected from wall 60 (and also unconnected from wall 80) wall 22 may be lifted or raised vertically approximately 25 millimeters, which frees it from a vertical lock system, also described as a co-planar locking system within hinge 100 to allow rotation relative to lower wall 104 about the horizontal hinge axis of hinge 100. Thus, when unrestricted by walls 60 and 80, the wall 22 may be raised approximately 25 millimeters to engage a hinge axis and then rotated either inwardly, i.e., such that face 26 moves to approach the base 92, or alternatively wall 22 may be rotated outwardly about the axis of hinge 100 such that the inside face 26 is facing upwardly and the outside face 24 is directed downwardly. In such an outward rotated horizontal orientation, wall 22 may be separated from base wall 104 at hinge 100 by a radial motion away from the hinge axis.

Further, note that the properties of hinges 100 and 110 (and similar hinges located on walls 38 and 80) are such the inside when the walls are rotated inwardly i.e., such that there inward faces 26, 64, 42, and 84 approach the base 92, they do not separate from their respective hinges i.e., hinges 100, 110 (and two other hinges not shown). By careful measured arrangement of the height of the lower walls, for example 104 and 114 and analogous lower walls at the bases of walls 80 and 38, it is possible to fold the various walls, 22, 38, 60 and 80 one on top of another on top of the base 92. Specifically, this operation is performed by first raising a vertical wall, for example wall 60, approximately 25 millimeters from its lower wall, for example, lower wall 114. This vertically raised status frees the edge 68 from the connecting lugs 32 of wall 22. Similarly edge 70 of wall 60 is freed from the connecting lugs 52 of wall 38. Next, wall 60 is rotated inwardly about the axis of hinge 110, such that inside face 64 of wall 60 abuts or adjoins the base 92.

Next, wall 80 is similarly lifted approximately 25 millimeters relative to the base 92 and a lower wall (not shown) on an analogous hinge. This lifting frees the vertical end 90 from the connecting lugs 36 of wall 22 and the vertical end 88 from the connecting lugs 48 of wall 38. Next, wall 80 is rotated inwardly about the axis of its analogous hinge, until the inside face 84 of wall 80 adjoins and substantially rests upon the outer wall 62 of previously inwardly rotated wall 60. The elevation of the hinge axis near the base of wall 80 is approximately identical to that of hinge 110. Thus, at the completion of this second step, the face of the base unit 92 is covered by the inside face 64 of wall 60, and the outer face 62 of wall 60 is covered by the inside face 84 of wall 80. The outer face 82 of wall 80 is now the upper most face exposed over the base unit 92.

At the end of this step, walls 38 and 22 remain in substantially vertical orientations, by virtue of a coplanar locking mechanisms present in the hinge mechanism, 100 at the base of wall 22 and an analogous hinge mechanism near the base of wall 38. By "co-planar" hereinafter is meant that the surfaces of two hinged walls share a common plane.

Next, wall 22 is raised approximately 25 millimeters from the base wall 104 and base 92. This vertical rise frees wall 22 from the co-planar locking mechanism incorporated within the hinge 100. Wall 22 may then be rotated inwardly such that the inside face 26 approaches the now horizontal outer face 82 of wall 80. The outer face 24 of wall 22 is now the upper most surface on top of the base unit 92. Next, wall 38, held in a vertical position by a co-planar locking mechanism in the analogous hinge near the base of the wall 38, is lifted or raised approximately 25 millimeters and similarly rotated inwardly about the axis of the hinge mechanism such that the inside face 42, of wall 38 approaches the now horizontal outer face 24 of wall 22. Thus, all 4 walls are connected in a neat package and folded upon the base 92, each connected by a unique hinge mechanism to an associated lower wall extending upwardly from base 92. In other words, base 92 is covered by wall 60, which in turn is covered by wall 80, which in turn is covered by wall 22, which in turn is covered by wall 38. The height of the collapsed container in such a situation slightly exceeds the thickness of the base 92 and the thicknesses of the four walls, and further including the thickness of the various connecting lugs 32, 36, 48 and 52. Alternatively, wall 80 may precede and underlie wall 60 which in turn may be covered by wall 38 and wall 22. This available alternative order of collapsing is advantageous to operators who may be initially standing near wall 80 instead of wall 60.

Figure 3:
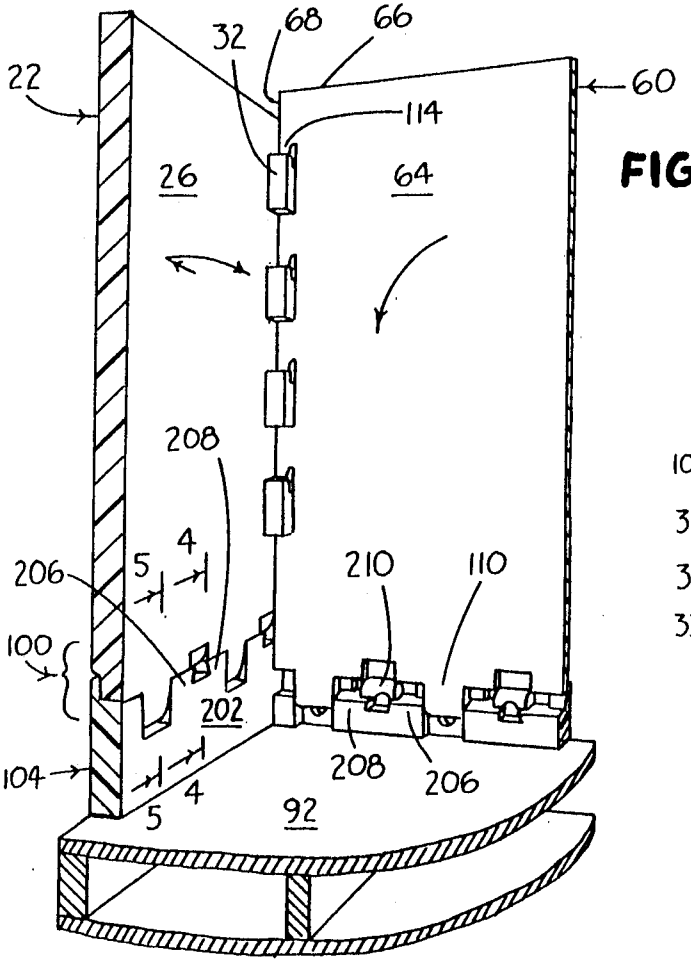
FIG. 3 is another perspective view at line 2—2 of FIG. 1.
Figure 9:
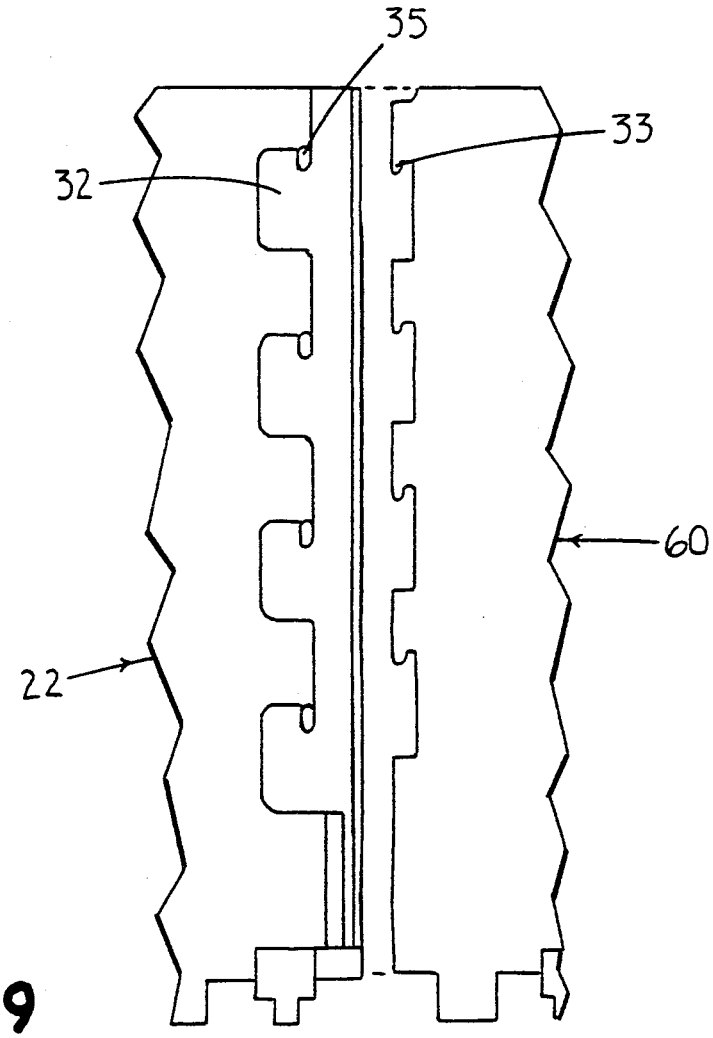
FIG. 9 is an exploded sectional view of the preferred embodiment.

In FIG. 3 the hinge mechanism 110 is shown when wall 60 has been elevated approximately 25 millimeters, in order to release it from the co-planar locking mechanism of hinge 110. Lug engaging pins 33 of wall 60 disengage from lugs 32 at the edge 68 of wall 22 and are cleared to rotate inwards. As further indicated in FIG. 9, lugs 32 have receiving slots 35 which hold pins 33 when the pins 33 are in a lower position.

As previously indicated, the present invention also includes a hinge, such as hinges on each wall, 100, 110, etc. The hinge 100 of the present invention incorporates an unusual combination of features. First, the hinge 100 may be separated into a first hinge member and a second hinge member. Second, the hinge provides an axis of rotation about which connected first and second hinge members may be rotated. With a few notable exceptions, this rotation may be through approximately 180 degrees of rotation. Third, the hinge incorporates a co-planar locking mechanism wherein, when the first and second hinge members are in a co-planar relationship, they may be commonly inserted, one within another, i.e., by sliding the first and second hinge members together and separating the rotation axis of the first member from the second member. This co-planar locking mechanism is useful, for example, for holding a free standing vertical panel or wall in a vertical position. Fourth, the hinge 100 serves as a useful connector in a knockdown container.

Figure 6:
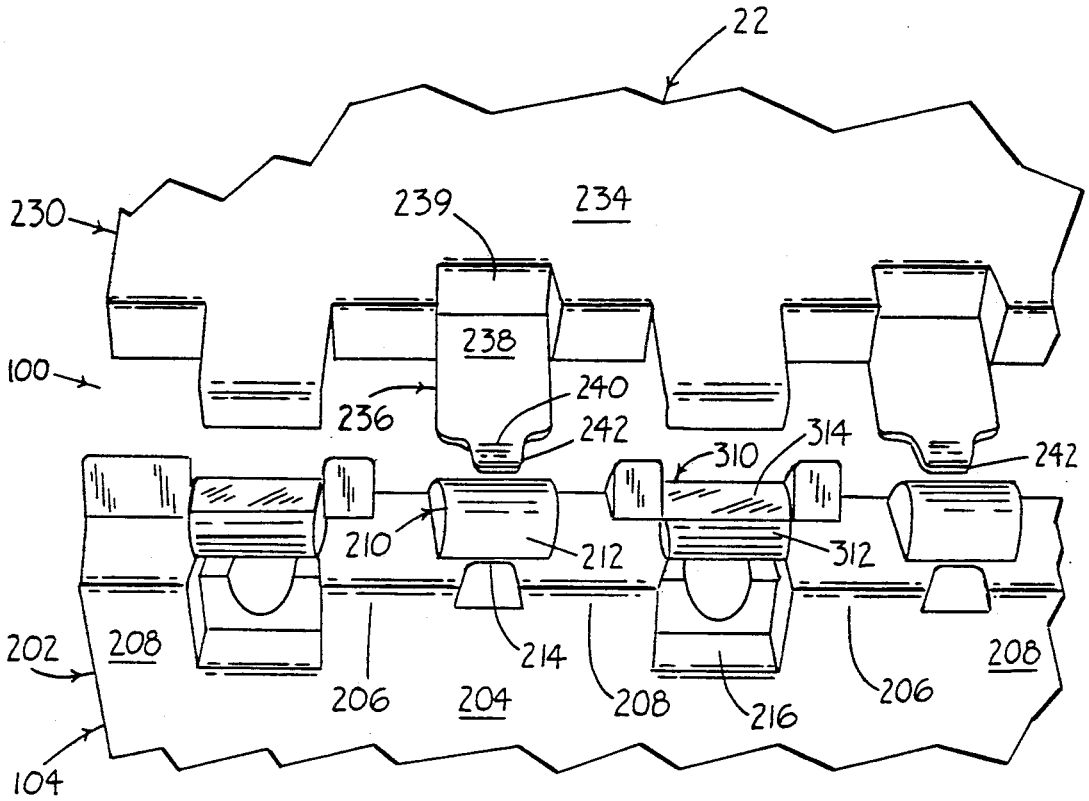
FIG. 6 is an exploded portion of the preferred embodiment.

The hinge includes a first hinge member 202, as shown in FIG. 6, which is integrally connected and adjoins the top of lower wall 104. The first hinge member 202 includes a hinge body 204 longitudinally extended along the length of the first hinge member 202. Support members 206 and 208 project transversely or perpendicularly upwardly from the first hinge body 204. A first hinge pin 210 extends between and is supported by the support members 206 and 208 in a parallel and spaced apart relationship to the first hinge body 204. The first hinge pin 210 has a generally cylindrical surface 212, interrupted by a flat surface 214 which is facing downward. Flat surface 214 is connected to cylindrical surface 212 at two parallel lines. The first hinge member 202 also includes a slotted slide or guide surfaces 216 adapted for slidable receiving and guiding.

The co-planar lockable hinge 100 also includes a second hinge member 230. The second hinge member 230 includes a longitudinally extending body 234. In a preferred embodiment, the longitudinally extending hinge body 234 is the lower edge of the wall 22. The second hinge member also includes a transverse arm or member 236 projecting from the second hinge member body 234. The transverse member 236 includes a vertical slide or guide surface 238 and a hinge pin receiving surface 240. The hinge pin receiving surface 240 has a radius which is complimentary or similar to that of hinge pin 212. The hinge pin receiving surface 240 is spaced apart from the second hinge pin body 234 by the slide or guide surface 238. The transverse member 236 lies closest to the outer face 24 of wall 22 and curves inwardly at the receiving surface 240, eventually terminating at an inward curving finger 242. The flat surface 214 on the bottom side of hinge pin 212 is adapted to receive the inward curving finger 242 during radially directed inward insertion of the second hinge member 230 into the first hinge member 220, such that the axis of the receiving surface 240 and inwardly curved finger 242 becomes coincidental with the pivot access of hinge pin 212. Thus establishing a hinge connected relationship.

Figure 4:
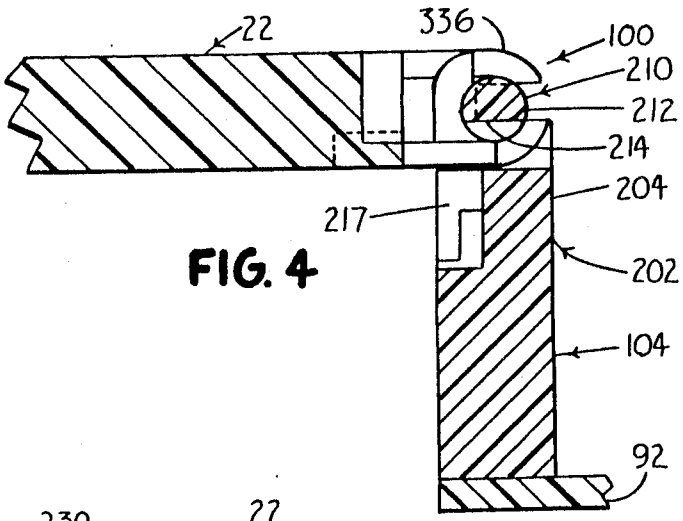
FIG. 4 is an enlarged sectional view at 4—4 of FIG. 3.

The insertion clearance for the insertion of finger 242 and receiving surface 240 of transverse member 236 is also shown in section in FIG. 4. The flat surface 214, allows insertion clearance for inward directed finger 242. The complimentary or similar radiuses of the curve surface 240 extend into finger with the radius being similar to cylindrical surface 212 of the pin 210.

Because the thickness of the transverse member 236 is approximately 6 millimeters, the thickness of the wall 22 is about 38 millimeters, and the radius of the cylindrical surface 212 is about 12–13 millimeters, the interaction of the receiving surface 240 with the centrally located hinge pin surface 212 allows a co-planar relationship between wall 22 and base wall 104.

The first member 202 of hinge 100 also includes a second hinge pin 310. The second hinge pin 310 has a cylindrical surface 312, preferably with a radius of 12–13 millimeters on a common axis with the first hinge pin 210. The cylindrical surface 312 does not form a full cylinder, but rather is interrupted on a top surface by a flat surface 314, which is perpendicular to the surfaces of lower wall 104. The second hinge pin 310 is supported by support projections 208 and 206.

The second hinge member 230 also includes a second arm or projecting pin bearing member 336. Member 336 has an inside face parallel to and extending from inside surface 26. Member 336 is also approximately 6 millimeters thick. At its lower terminus 338, member 336 curves outward. The outside face of member 336 has a pin bearing surface 340, as shown in FIG. 5, having approximately a 12–13 millimeters radius and adapted to bear against the cylindrical surface 312 of the second hinge pin 310.

Figure 5:
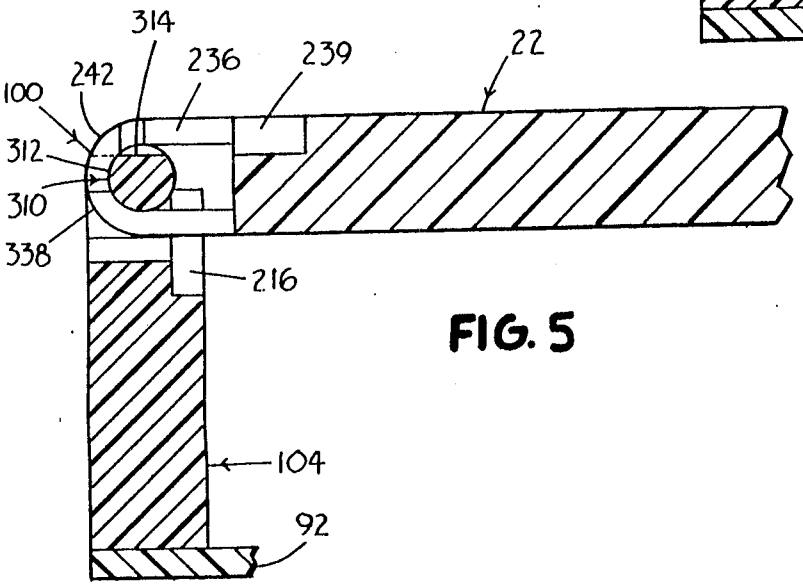
FIG. 5 is an enlarged sectional view at 5—5 of FIG. 3.

When wall 22 has been rotated about the axis of hinge 100, such that wall 22 lies over the base 92 and the inside face 26 is directed downward, pin bearing surface 340 is held in contact with the cylindrical surface 312 of the second hinge pin 310, as shown in FIG. 5. Additionally, finger 242 is held in contact with the cylindrical portion of the surface 212 of the first hinge pin 210.

When wall 22 has been rotated about the axis of hinge 100, such that wall 22 lies away from the base 92 and the inside face 26 is directed upward, as shown in FIG. 4, the terminus 338 of pin bearing surface 340 may pass outwardly, sliding across the flat upper surface 314 of the second hinge pin 310. Additionally, finger 242 of projection 236 may pass outwardly, sliding across the flat lower surface 214 of the first hinge pin 210.

Figure 7:
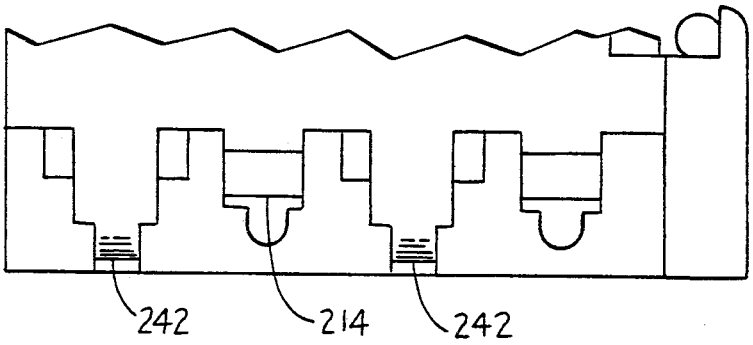
FIG. 7 is an exterior side view of the preferred embodiment in a locked position.
Figure 8:
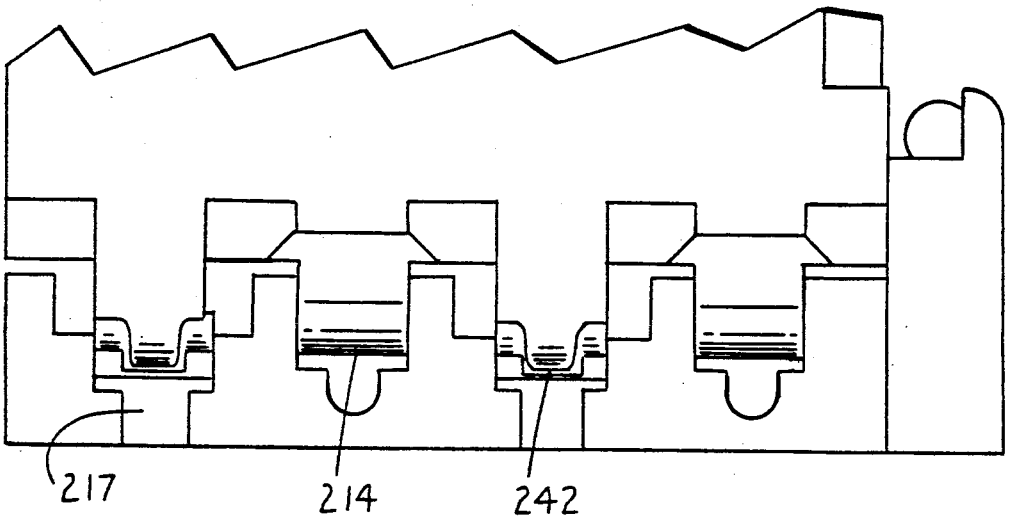
FIG. 8 is an outside side view of the preferred embodiment in an extended or unlocked position.

When the wall 22 is in a vertical or upright position, the downwardly extending members 236 and 336 may slide downwardly into receiving slots 216 and 217 respectively. The hinge pins 210 and 310 are simultaneously received by receiving slots 239 and 339 respectively. When slid together, as just described, the wall is locked in an upright position, i.e., a co-planar relationship is maintained between wall 22 and lower wall 104, as shown in FIG. 7. As shown in FIG. 8, the wall 22 may be vertically raised or lifted to again engage the cylindrical surfaces 212 and 312 and allow rotation about the axis of the horizontal hinge 100.

The preferred material for the collapsible container 20 of the present invention is high density polyethylene. Containers of the present invention may be prepared by blow molding. Casting and compression molding are also methods which may be employed to fabricate containers of the present invention.

Although the present invention has been described with reference to the preferred embodiments, workers skilled in the art will recognize that changes may be made in form and detail without departing from the spirit and scope of the invention.

What is claimed is:

1. A separable hinge comprising:

a first hinge member including:

a first hinge pin, having a surface including a portion of cylindrical surface and a single flat surface connected to the portion of cylindrical surface at two parallel lines;

a second hinge pin, spaced longitudinally apart from the first hinge pin and having a common axis with the first hinge pin, having a surface including a portion of cylindrical surface and a single flat surface connected to the portion of cylindrical surface at two parallel lines, the flat surface of the second hinge pin facing an opposite direction from the flat surface of the first hinge pin;

a second hinge member including:

a first arm having a pin contacting surface, adapted to rotate about the cylindrical surface portion of the first hinge pin;

a second arm, spaced apart from the first arm, having a pin contacting surface, adapted to rotate about the cylindrical surface portion of the second hinge pin when the first arm rotates about the first hinge pin; and wherein the first and second arms can be simultaneously separated from the first and second hinge pins by radially directed removal in a direction parallel to the flat surfaces of the first and second hinge pins.

2. The hinge of claim 1 and wherein the first hinge member further includes:

a recess for slidably receiving the first arm; and a recess for slidably receiving the second arm; and wherein the second hinge member further includes:

a recess for receiving the first hinge pin; and a recess for receiving the second hinge pin; and wherein the first and second hinge members may be coinserted to form a co-planar lock.

* * * * *